US008276766B2

(12) United States Patent
Rataiczak, III et al.

(10) Patent No.: US 8,276,766 B2
(45) Date of Patent: Oct. 2, 2012

(54) ADJUSTABLE DEPTH MERCHANDISING APPARATUS

(75) Inventors: James J. Rataiczak, III, Chesterland, OH (US); Paul A. Mueller, Wadsworth, OH (US); Daniel J. Kump, Highland Heights, OH (US)

(73) Assignee: Fasteners For Retail, Inc., Twinsburg, OH (US)

( * ) Notice: Subject to any disclaimer, the term of this patent is extended or adjusted under 35 U.S.C. 154(b) by 330 days.

(21) Appl. No.: 12/575,751

(22) Filed: Oct. 8, 2009

(65) Prior Publication Data

US 2010/0089847 A1 Apr. 15, 2010

Related U.S. Application Data

(60) Provisional application No. 61/104,140, filed on Oct. 9, 2008.

(51) Int. Cl.
*A47F 7/00* (2006.01)

(52) U.S. Cl. ..... 211/59.3; 211/184

(58) Field of Classification Search ..... 211/59.3, 211/59.2, 184, 175; 312/61, 71
See application file for complete search history.

(56) References Cited

U.S. PATENT DOCUMENTS

| | | | | |
|---|---|---|---|---|
| 4,478,337 | A | 10/1984 | Flum | |
| 4,712,694 | A | 12/1987 | Breslow | |
| 4,830,201 | A * | 5/1989 | Breslow | 211/184 |
| 4,836,390 | A | 6/1989 | Polvere | |
| 5,325,792 | A * | 7/1994 | Mulloy | 108/28 |
| 5,673,801 | A * | 10/1997 | Markson | 211/59.3 |
| 5,803,276 | A | 9/1998 | Vogler | |
| 5,971,173 | A * | 10/1999 | Valiulis et al. | 211/184 |
| 6,082,558 | A * | 7/2000 | Battaglia | 211/59.3 |
| 6,409,028 | B2 * | 6/2002 | Nickerson | 211/59.3 |
| D473,080 | S * | 4/2003 | Kellogg | D6/491 |
| 6,685,037 | B1 * | 2/2004 | Zadak | 211/184 |
| 6,991,307 | B2 * | 1/2006 | Hoenig | 312/348.3 |
| 7,066,563 | B2 | 6/2006 | Berger | |
| 7,293,663 | B2 | 11/2007 | Lavery, Jr. | |
| 7,395,938 | B2 * | 7/2008 | Merit et al. | 211/59.4 |
| 7,478,731 | B1 * | 1/2009 | Mason | 211/59.3 |
| 7,823,734 | B2 | 11/2010 | Hardy | |
| 7,926,668 | B2 * | 4/2011 | Barkdoll | 211/59.3 |

(Continued)

FOREIGN PATENT DOCUMENTS

EP 1 772 078 B1 4/2007

(Continued)

*Primary Examiner* — Jennifer E. Novosad
(74) *Attorney, Agent, or Firm* — Fay Sharpe LLP

(57) ABSTRACT

An adjustable depth merchandising apparatus includes an elongated mounting member operationally securable to an associated shelf and extending parallel to a longitudinal axis thereof. An adjustable divider system is selectively connected to the mounting member. The divider system includes a first divider portion and a second divider portion. Each portion contains connecting elements, which selectively engage each other to operatively connect the first divider portion to the second divider portion, thereby enabling the divider system to be employed on associated shelves of varying depths. A trackless pusher system is selectively received on the mounting member. The pusher system includes a mounting clip engaging the mounting member, a coil spring connected to the mounting clip and a pusher body slidably mounted in relation to the mounting member, wherein the coil spring is supported by the pusher body and connects the pusher body to the mounting clip. Both the divider system and the pusher system have a length which can be adjusted, thereby enabling the two systems to be employed on associated shelves of varying depths.

18 Claims, 10 Drawing Sheets

U.S. PATENT DOCUMENTS

| | | | | |
|---|---|---|---|---|
| 7,971,735 | B2 * | 7/2011 | Mueller et al. | 211/59.3 |
| 8,016,128 | B2 * | 9/2011 | Valiulis et al. | 211/59.3 |
| 8,025,162 | B2 | 9/2011 | Hardy | |
| 8,069,994 | B2 * | 12/2011 | Barkdoll | 211/59.3 |
| 2002/0108916 | A1 * | 8/2002 | Nickerson | 211/59.3 |
| 2003/0024889 | A1 * | 2/2003 | Dumontet | 211/59.3 |
| 2004/0245197 | A1 | 12/2004 | McElvaney | |
| 2005/0139560 | A1 * | 6/2005 | Whiteside et al. | 211/119.003 |
| 2006/0049122 | A1 * | 3/2006 | Mueller et al. | 211/59.3 |
| 2007/0187344 | A1 * | 8/2007 | Mueller et al. | 211/59.3 |
| 2007/0251900 | A1 | 11/2007 | Hardy | |
| 2007/0267364 | A1 | 11/2007 | Barkdoll | |
| 2008/0017598 | A1 * | 1/2008 | Rataiczak et al. | 211/59.3 |
| 2010/0089847 | A1 * | 4/2010 | Rataiczak et al. | 211/59.3 |
| 2010/0200526 | A1 | 8/2010 | Barkdoll | |
| 2011/0174750 | A1 * | 7/2011 | Poulokefalos | 211/59.3 |
| 2012/0006773 | A1 * | 1/2012 | Mueller et al. | 211/59.3 |

FOREIGN PATENT DOCUMENTS

| | | |
|---|---|---|
| GB | 697994 | 10/1953 |
| WO | WO 2011/075261 A1 | 6/2011 |

* cited by examiner

ADJUSTABLE DEPTH MERCHANDISING APPARATUS

This application claims priority from Provisional Application Ser. No. 61/104,140 which was filed on Oct. 9, 2008. The entire content of that application is incorporated hereinto by reference.

FIELD OF THE DISCLOSURE

The present disclosure generally relates to adjustable merchandising systems. More particularly, it is pertinent to an adjustable merchandising apparatus for storing and displaying merchandise having a variety of shapes and sizes, and urging such merchandise towards the front of a shelf. The merchandising apparatus is configured to organize merchandise on the shelf into rows.

BACKGROUND OF THE DISCLOSURE

Shelving is used extensively for stocking and storing products or merchandise in numerous types of retail establishments, such as grocery stores and drug stores. Many stores simply employ shelves on which merchandise is stocked. In such stores, for the shelves which are not at eye level, it is difficult for the customer to see the items being displayed, if they are not located adjacent the front edge of the shelf. Therefore, it is desirable for merchandise to be displayed at the front of the shelf so that the customer can see the merchandise and be induced to purchase such merchandise. Also, such shelves make it difficult to rotate product, i.e., move the older stock to the front of the shelf and position newer stock behind the older stock. Rotating products is an important consideration if the goods are perishable or are subject to becoming stale.

Numerous forward feed devices have been proposed to automatically move an item forward on a shelf, as the item before it is removed. These devices generally fall into one of three categories. The first category includes inclined tracks, which rely on gravity to feed, slide or roll products forward. A second category employs conveyor belts, which still use gravity to effect forward movement. A third category, that has become popular in recent years, uses spring biased paddles in a pusher system to feed the product forward on a horizontally oriented shelf. Such pusher systems have been found useful in a variety of merchandising applications.

Forward feed devices are usually associated with divider walls. Normally, a divider wall is located on either side of a pusher mounted on a track (i.e., pusher system) so as to maintain the merchandise in rows. In certain designs, both the pusher system and the divider wall are mounted to at least a front rail, or front mounting member of the merchandising system, in order to allow a proper spacing of the pusher tracks and the divider walls on a shelf. In some known systems, the divider walls are separate from the pusher tracks. In others, the divider walls and pusher tracks are integrated into a one piece design. In either case, the divider walls and pusher tracks are, in some designs, slidably mounted on the front rail or mounting member. In other designs, one or both are fixedly mounted in relation to the front rail. In still other designs, both a front rail and a rear rail are employed and one or both of the pusher tracks and the divider walls are either fixedly secured to one or both of the front rail and the rear rail or slidably mounted thereon.

The purpose for employing a track with a pusher system is in order to the center the pusher behind the merchandise and to guide the pusher forward. However, such tracks are prone to be clogged with debris and then stick or malfunction. Perhaps more importantly, both the divider and the track are normally of a given size or length. Therefore, for shelves of varying depths, numerous different length dividers and tracks have to be provided.

Therefore, there exists a need in the art for a merchandising system which is able to readily accommodate shelves of varying depths.

SUMMARY OF THE DISCLOSURE

According to one aspect of the present disclosure, an adjustable length divider system is provided for use in merchandising. The divider system comprises a first divider portion including a longitudinal axis and a first base section, on which is defined a first connecting element. The system also comprises a second divider portion including a longitudinal axis and a second base section, on which is defined a second connecting element. The first and second connecting elements selectively engage each other such that the second divider portion is selectively detachable from the first divider portion and is movable along the longitudinal axis of the first divider portion to allow a length of the divider system to be changed. In this way, the divider system is able to be employed on associated shelves of varying depths.

According to another aspect of the present disclosure, a pusher system is provided for biasing retail merchandise forward. The pusher system comprises a mounting clip which selectively cooperates with an elongated mounting member and a pusher body. A spring extends between and connects the mounting clip to the pusher body. The spring acts on the pusher body to bias it towards the mounting clip. The pusher body is physically separate from the mounting clip and is connected thereto only by the spring, such that the pusher system has a length which can be adjusted, thereby enabling the pusher system to be placed on associated shelves of varying depths.

According to a further aspect of the present disclosure, there is provided an adjustable depth merchandising apparatus. The adjustable length merchandising apparatus comprises an elongated mounting member operationally securable to an associated shelf and extending parallel to a longitudinal axis thereof. An adjustable divider system is selectively connected to the mounting member, wherein the divider system extends rearwardly over the associated shelf. A trackless pusher system is selectively connected to the mounting member and extends rearwardly over the associated shelf. Each of the divider system and the pusher system is selectively extendable so that an operative length of the respective system can be adjusted, thereby enabling the merchandising apparatus to be employed on associated shelves of varying depths.

BRIEF DESCRIPTION OF THE DRAWINGS

The present disclosure may take form in certain parts and arrangements of parts, an embodiment of which will be described in detail in this specification and illustrated in the accompanying drawings which form a part hereof and wherein.

DETAILED DESCRIPTION

Figure 1:
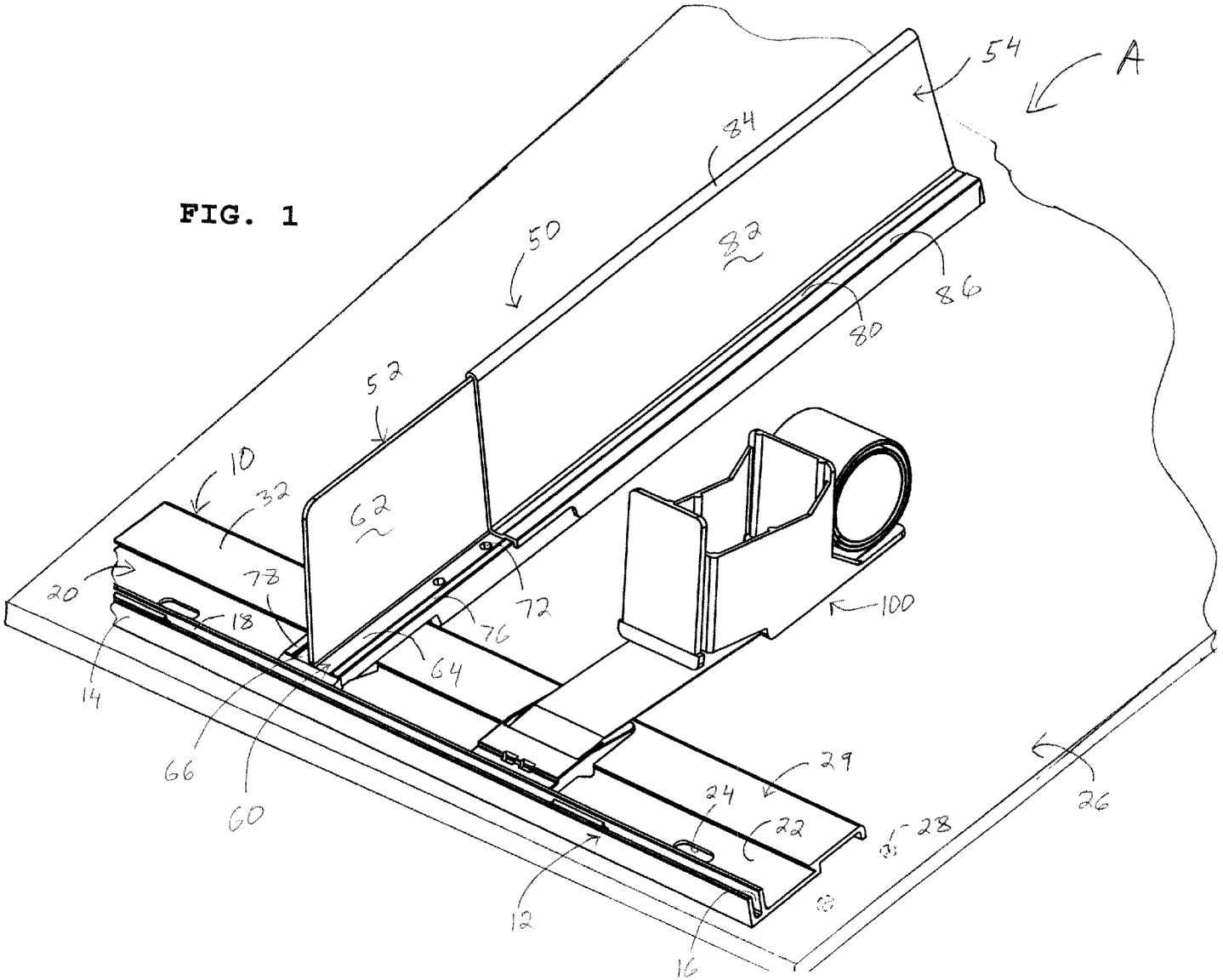
FIG. 1 is a perspective view of an adjustable depth merchandising apparatus according to an embodiment of the present disclosure.

Referring now to the drawings, wherein the showings are for purposes of illustrating a preferred embodiment of the disclosure only and not for purposes of limiting same, FIG. 1 illustrates an embodiment of a merchandising apparatus A according to the present disclosure. In this embodiment, an elongated mounting member, which can be a front rail 10, includes a vertically oriented wall 12, which comprises a first section 14, a groove 16 and a second section 18. The rail could also be positioned at a different location on the shelf. Also provided on the mounting member 10 is a horizontally oriented wall 20. Disposed in the horizontally oriented wall is a second groove 22. An aperture 24 is positioned in the second groove. It extends through the horizontally oriented wall 20 so that a suitable conventional fastener (not illustrated) can extend through the opening 24 so as to secure the mounting member in place on a subjacent shelf 26 via a suitable cooperating aperture 28. Such a construction is shown in U.S. Pat. No. 7,216,770 which issued on May 15, 2007. That patent is incorporated herein by reference in its entirety. Moreover, applicant has also filed a related case, application Ser. No. 10/854,991, which is dated May 27, 2004. Other related cases include application Ser. No. 11/356,398 which was filed on Feb. 16, 2006 and application Ser. No. 11/809,862 which was filed on Jun. 1, 2007. These applications are also incorporated herein by reference in their entireties.

Figure 2:
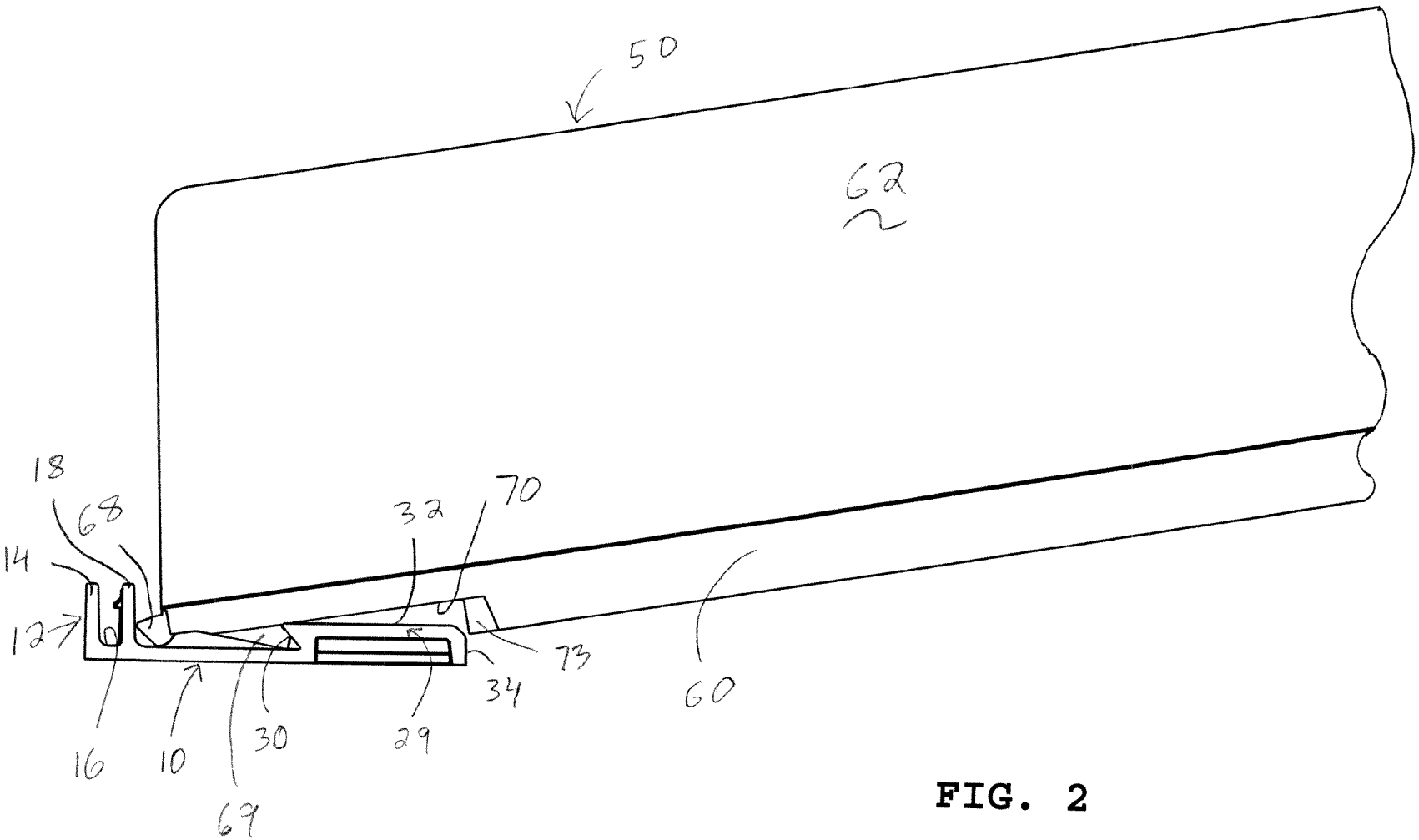
FIG. 2 is an enlarged side elevational view of a mounting member and a portion of the divider system of the merchandising apparatus of FIG. 1.

As shown in FIG. 2, the horizontally oriented wall 20 comprises the second groove 22 and a plateau-like raised section 29 which includes a front face 30, a top face 32 and a back face 34. A plurality of teeth (not visible) can be provided on, for example, the back face of the raised section.

A cooperating member, such as a divider system 50, is selectively mounted to the front rail 10. The divider system includes a first section 52 and a second section 54. The second section can be selectively mounted to the first section in a plurality of settings or detached therefrom. In this way, the length of the divider system can be changed so as to accommodate varying depths of shelving 26. It should be apparent that a variable size set of predetermined overall lengths of the shelving system 50 can be provided, depending upon the spacing of the cooperating connecting elements on the divider system first and second portions 52 and 54.

Figure 3:
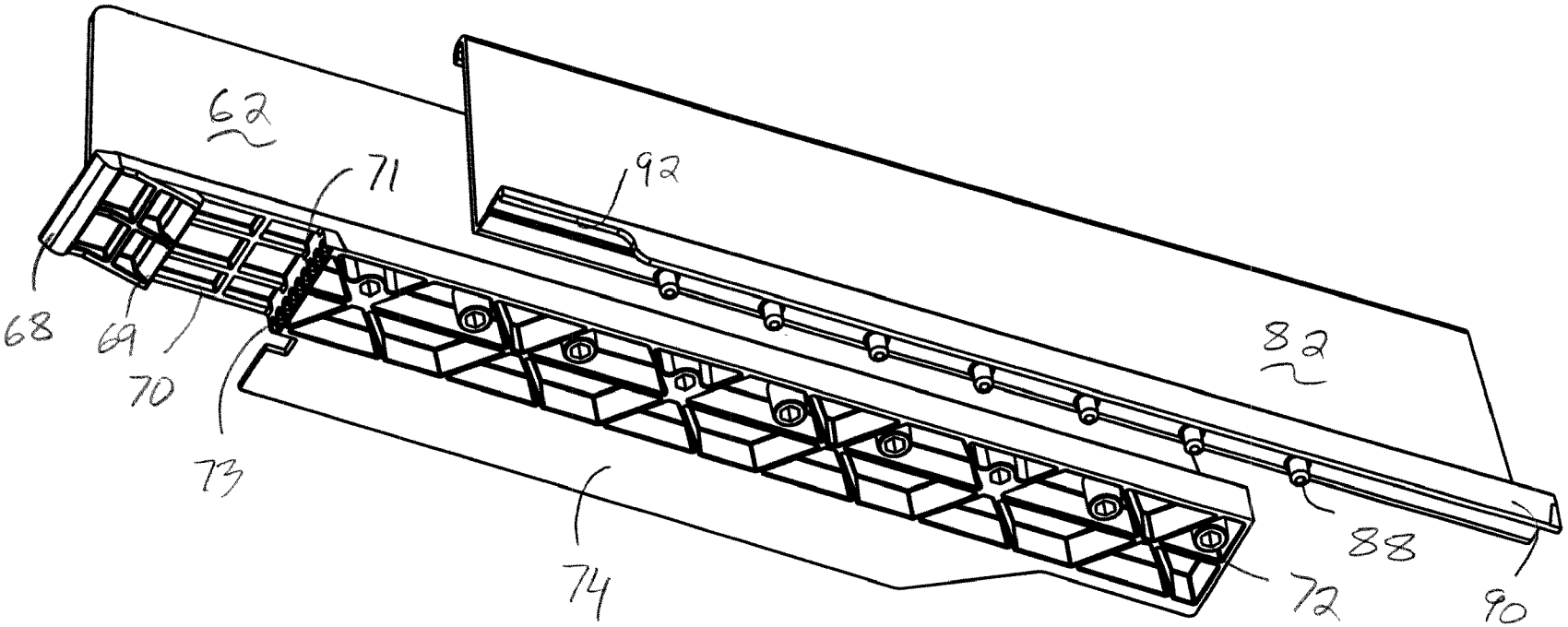
FIG. 3 is an enlarged exploded perspective view from beneath the divider system of FIG. 1.
Figures 4, 5:
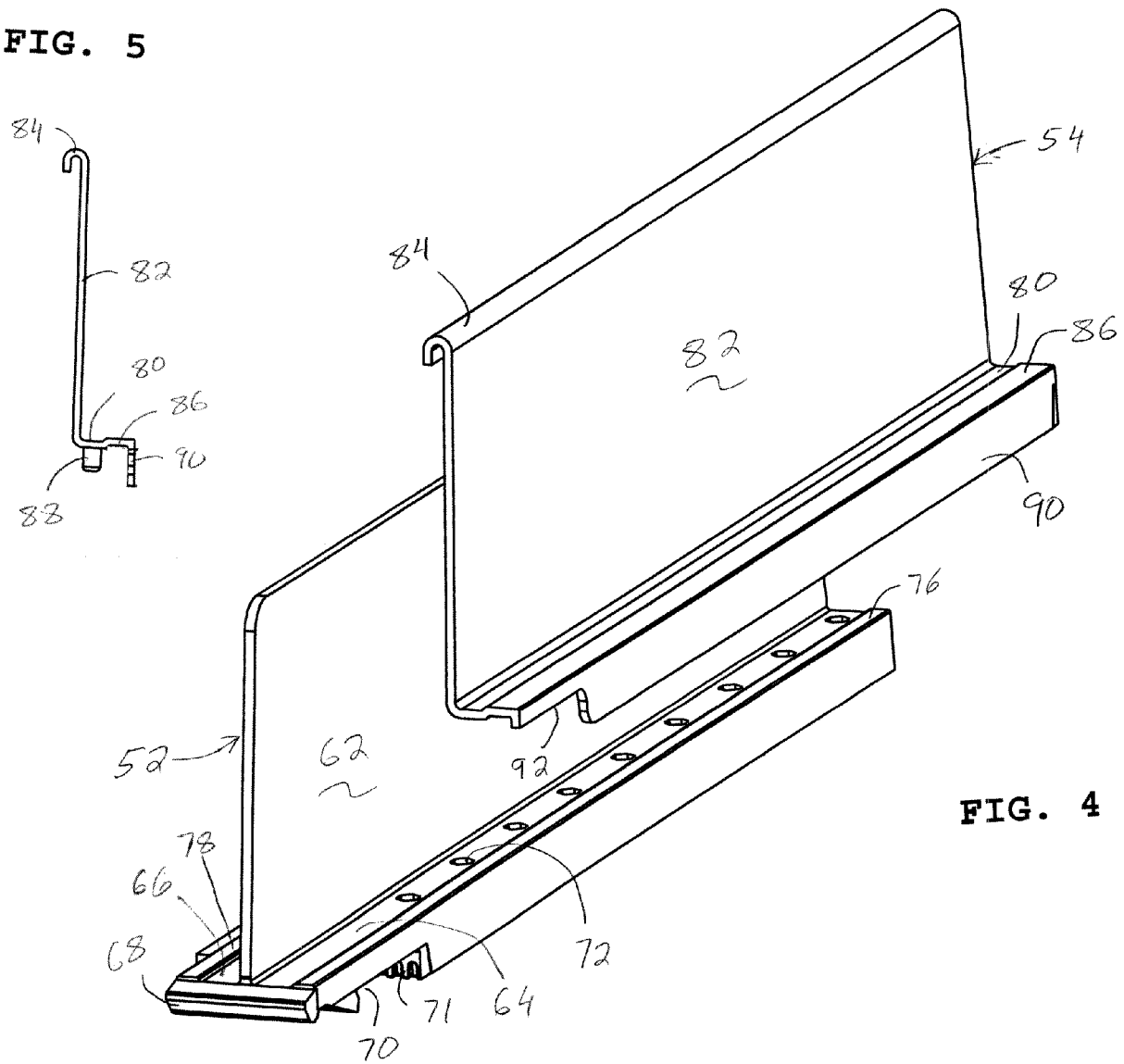
FIG. 4 is an exploded perspective view from above the divider system of FIG. 3, with the divider system shown in a disconnected condition.
FIG. 5 is a reduced side elevational view of a second portion of the divider system of FIG. 4.

With reference now also to FIGS. 3 and 4, the first portion 52 includes a base or horizontal portion 60 and an upright wall or dividing or barrier wall 62 that separates the base into a first base section 64 and a second base section 66. Extending from the front edge of the base 60 is a tongue 68. As is evident from FIG. 2, the tongue 68 can engage the second section 18 of the vertically oriented wall 12 of the front rail 10 when the divider system is mounted to the front rail. Also engaging the front rail is a projection 69 depending from a bottom face of the base 60. More particularly, the projection 69 engages the front face 30 of the plateau-like section 29. Positioned rearwardly from the projection 69 is a cross slot 70. One or more teeth 71 (see FIG. 3) defined on the base can protrude into the cross slot 70. These teeth can cooperate with and engage suitable teeth (not visible) on the plateau-like section 29, for example on the rear face 34 thereof. As can be seen from FIG. 4, a row of apertures 72 extend longitudinally on the base second section 66 along a longitudinal axis of the first portion 52.

As best seen from FIG. 3, a side wing 74 can extend from the base first section 64. The side wing 74 can be employed for wider merchandise or can be removed, i.e., broken away, for narrower merchandise as desired. Defined on the base 60 are a pair of rails 76 and 78. The rail 76 is located on the base first section 64 and the rail 78 is located on the base second section 66. The rails 76 and 78 may be useful for supporting side edges of merchandise on the dividers, should that be considered advantageous.

The divider system second portion 54 comprises a base or horizontal section 80 extending from which is an upright wall, divider or barrier 82. An overhang 84 protrudes from the upper end of the upright wall 82. Such overhang is beneficial in helping to keep the second portion 54 in place on the first portion 52. A rail 86 is defined in the base 80. With reference again to FIG. 3, a row of teeth 88 depend from a bottom surface of the base 80. These extend along a horizontal axis of the second portion 54. Also depending from the base 80 is a skirt or flange 90. A cut out 92 is defined in a forward portion of the skirt 90. The purpose for the cut out is to accommodate the front rail 10 when the front end of the second portion 54 is positioned close to the front end of the first portion 52.

Figure 6:
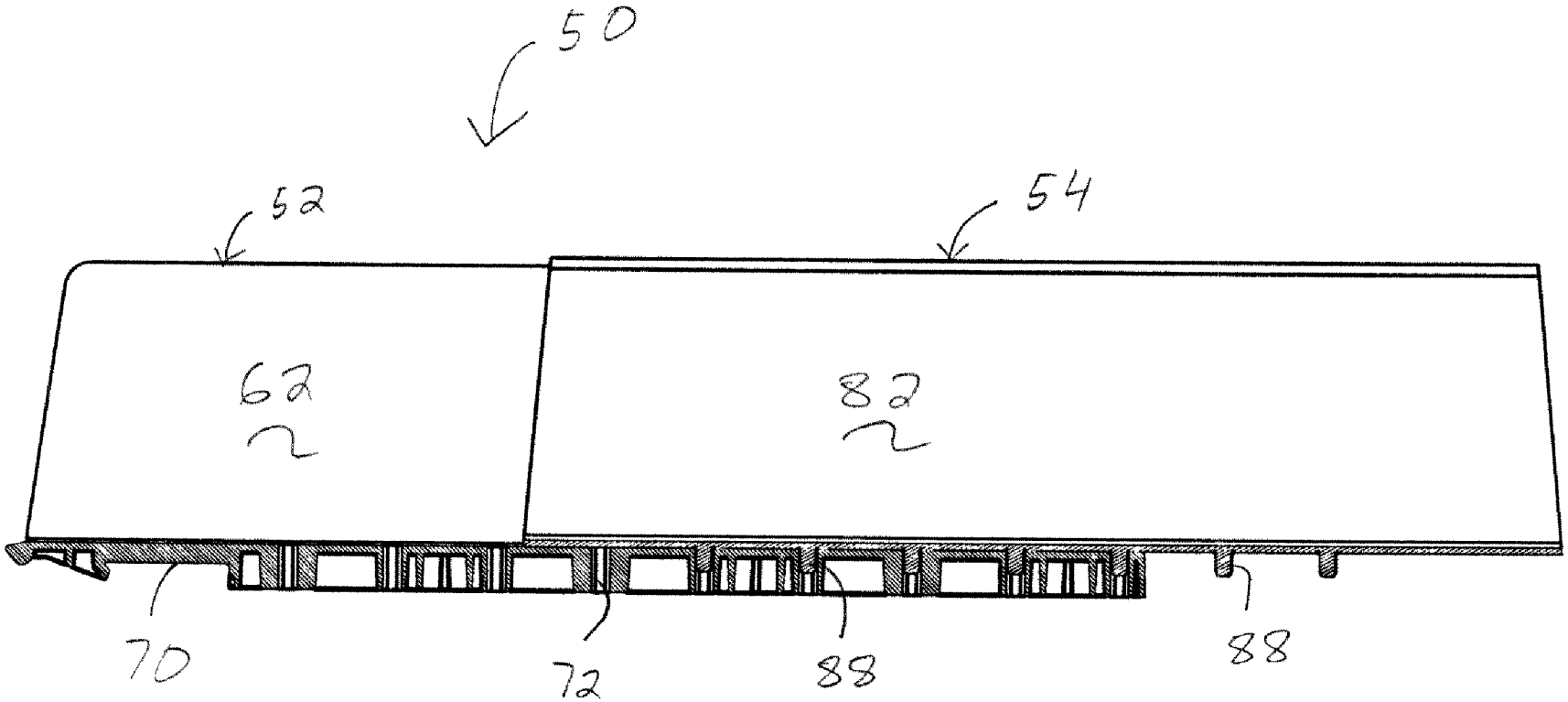
FIG. 6 is a reduced side elevational view partially in cross section of the divider system of FIG. 3 in a connected condition.

With reference now also to FIG. 6, it can be seen that the second portion can be selectively connected to or disconnected from the first portion 52. Such connection involves the row of studs or teeth 88 defined on the second portion 54 entering the row of apertures 72 defined in the first portion 52. Simply pulling the second section upwardly away from the first section, disengages the teeth 88 from the apertures 72. The second section 54 can then be moved along the axis of the first section 52 to a desired location. In this way, the length of the divider system can be either increased for a deeper shelf or reduced for a shallower shelf. Thus, the divider system is able to accommodate shelves of varying depths. It should be apparent that the fineness of the spacing of the teeth 88 and apertures 72 will determine the number of locations that the second divider section 54 can be moved to in relation to the first divider section 52. Thus, any number of shelf depths can be accommodated by suitably spacing the connecting elements of the first section and the second section in relation to each other. It should also be appreciated that other types of connecting elements or locking elements for connecting the second section to the first section and preventing movement therebetween can also be employed. The location of the teeth and apertures could be reversed, for example. Also, in other embodiments, resilient interengaging clips or strips of hook and loop fasteners could be employed on the two sections.

Figure 7:
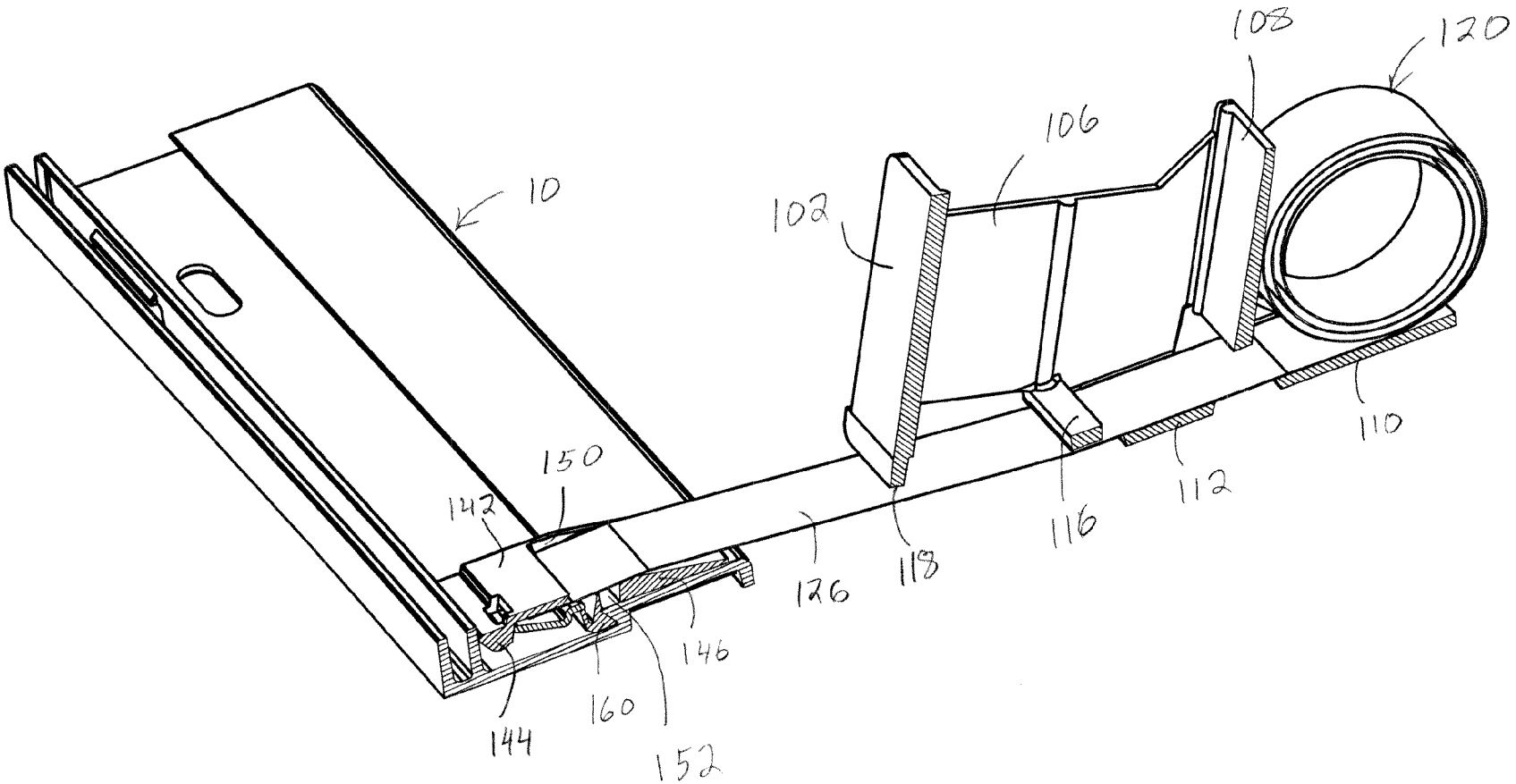
FIG. 7 is an enlarged perspective view partially in cross section of the elongated mounting member of FIG. 1 and a pusher system of FIG. 1.
Figure 8A:
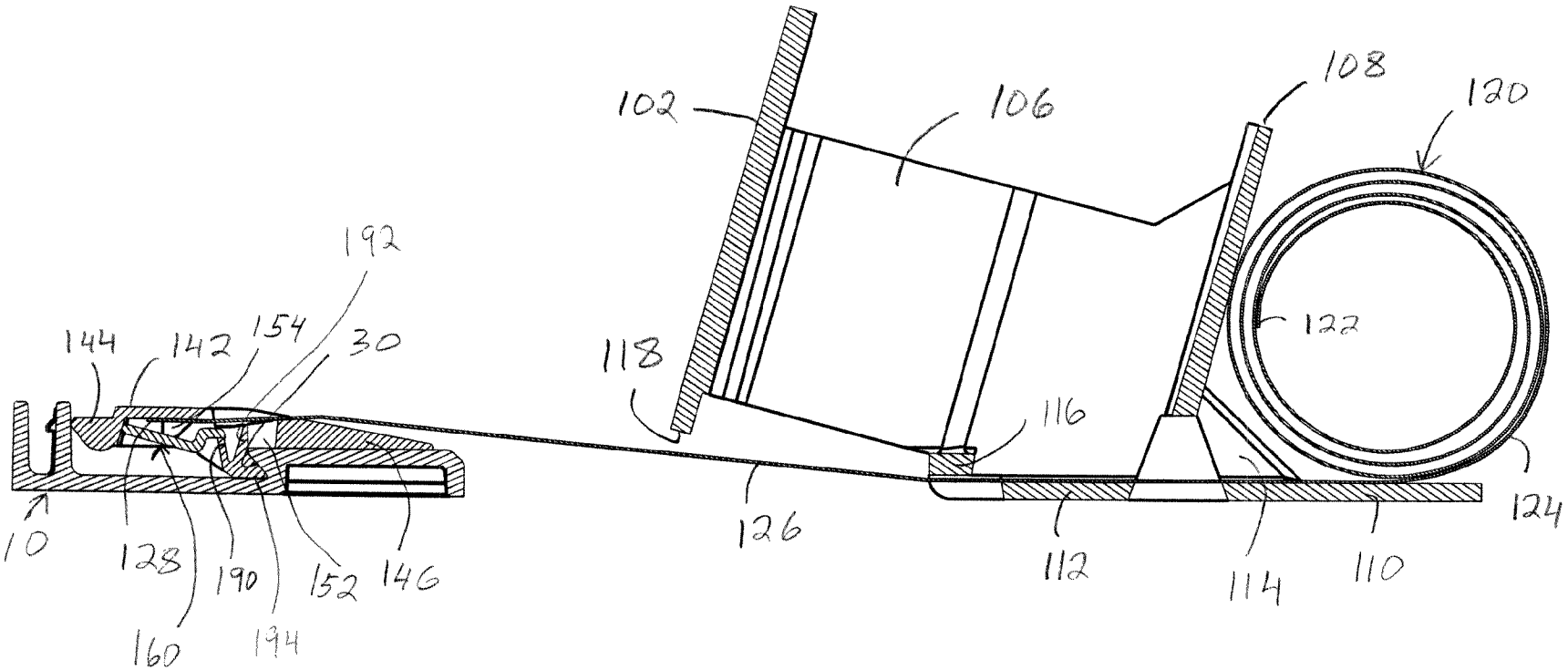
FIG. 8A is an enlarged side elevational view of the components of FIG. 7.
Figure 9:
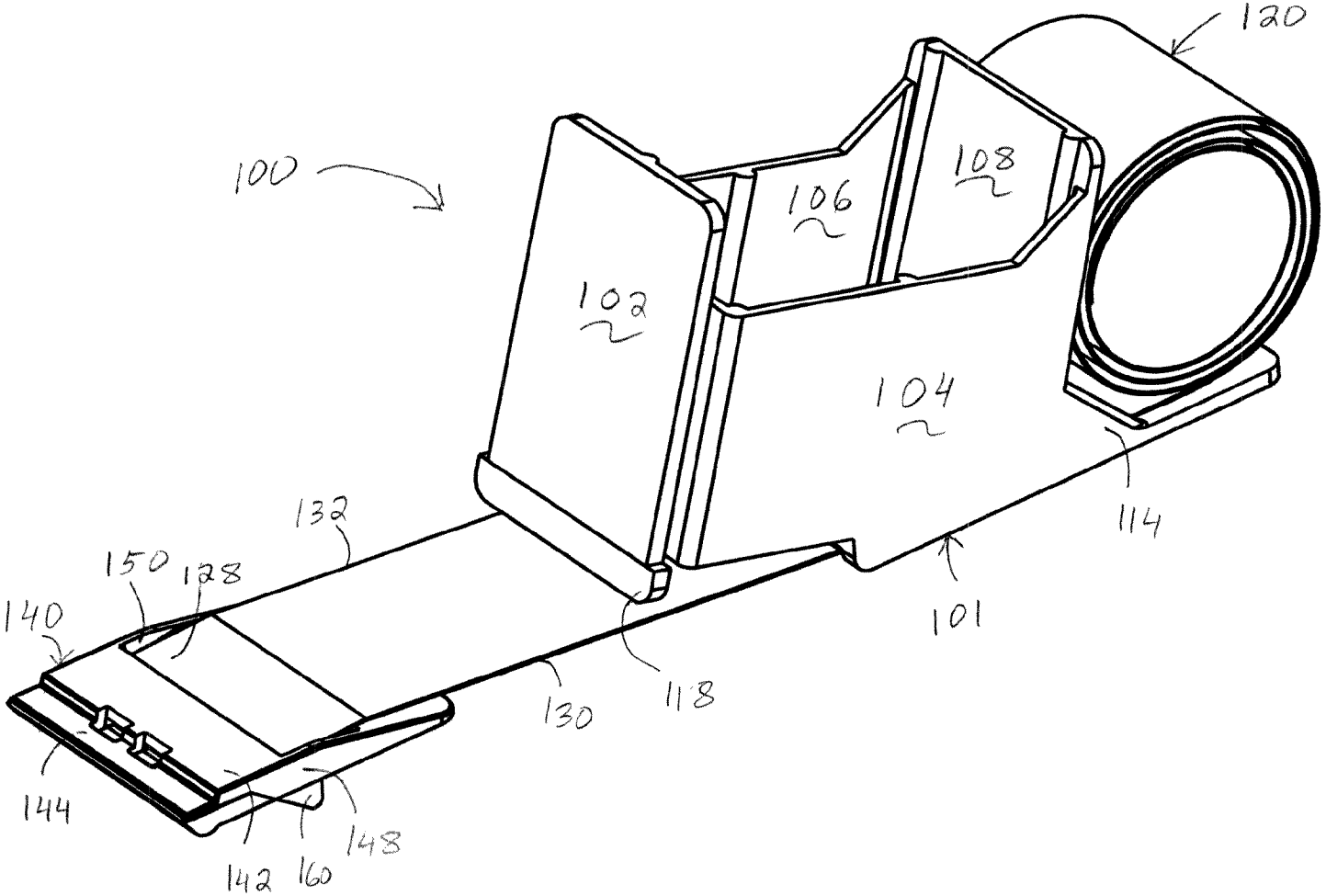
FIG. 9 is an enlarged perspective view of the pusher system of FIG. 1; and, FIG. 10 is an enlarged exploded perspective view from beneath a mounting clip of the pusher system of FIG. 9.

With reference again to FIG. 1, it can be seen that an adjustable length pusher system 100 can also be selectively mounted to the front rail 10, either adjacent to or spaced from the divider system 50. With reference now also to FIG. 9, the pusher system is trackless and includes a pusher body 101 comprising a front wall or face 102 which is adapted to contact merchandise in front of it, as well as first and second side walls 104 and 106 extending from the front wall. A rear wall 108 is connected to the two side walls 104 and 106, thus forming a somewhat box shaped or rectangular structure. With reference now also to FIG. 7, the pusher body 101 also includes a base wall. This includes a first section 110, which may be termed a flange, and, spaced therefrom, a second section 112, which may be termed a bracing member. As can be seen, the second section is mounted between the first and second side walls 104 and 106 giving the pusher body 101 some additional rigidity. The first section of the base wall 110 is mounted to the rear wall 108 via gussets 114, as shown in FIG. 8A. Spaced from the base wall second section 112 is a guide wall 116 that spans or extends between the pair of side walls 104 and 106 and is connected thereto. The guide wall is vertically spaced from the base wall second section 112. The guide wall 116 is also horizontally spaced from said front and rear walls 102 and 108. An enlarged bottom lip 118 extends from a bottom end of the front wall or pusher face 102.

A coil spring 120 is mounted on the pusher 101. More particularly, and as best shown in FIG. 8A, the coil spring includes a first end or rear end 122 and a coiled portion 124. The coiled portion is supported by the base wall first section 110. The coil spring also includes a straight or linear intermediate portion 126. This portion is threaded through the pusher body 101 such that the flat portion of the coil spring is supported by the upper surfaces of the base wall first and second sections 110 and 112 and is disposed beneath a lower surface of the guide wall 116, as best seen in FIG. 8A. Moreover, the bottom edge 118 of the front wall 102 is located above and is spaced from the coil spring straight portion 126. These elements of the pusher body 101 guide the spring 120 and regulate its movement. A stable pusher body is thus provided.

With reference again to FIG. 9, a front end or second end of the coil spring extends forwardly of the pusher body 101. In this embodiment, the coil spring has a first side edge 130 spaced a considerable distance from a second side edge 132 such that the coil spring is as wide as possible while still being accommodated in the pusher body 101. One benefit of providing a wide coil spring is that a relatively stable pusher system is provided. More particularly, the tendency of the pusher body 101 to pivot about a longitudinal axis of the pusher system 100 is reduced. Also, the tendency of the pusher body to move laterally is reduced. Further, the pusher body 101 has a relatively wide horizontal base portion. As such, the walls are provided with increased rigidity to prevent the walls from bowing or bending outwardly away from the merchandise. Moreover, the sufficiently rigid walls help maintain an approximately 90° angle between the front wall or face 102 and the pair of side walls 104 and 106.

Figure 8B:
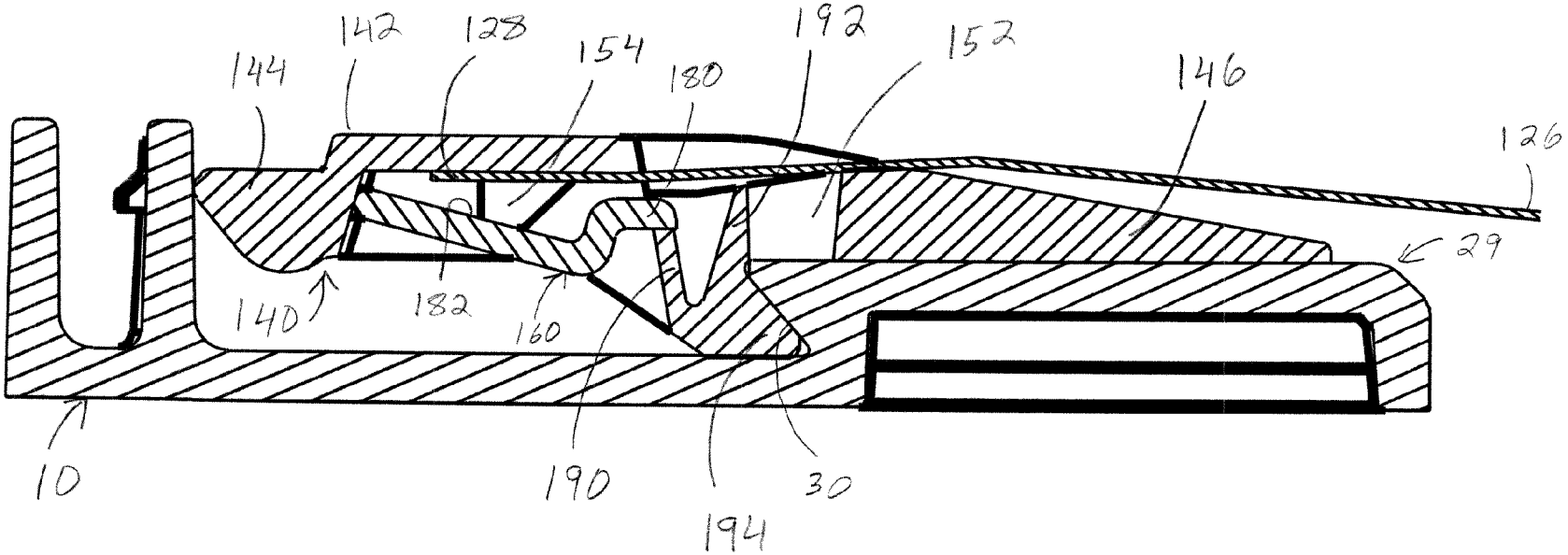
FIG. 8B is a further enlarged view of a portion of FIG. 8A.
Figure 10:
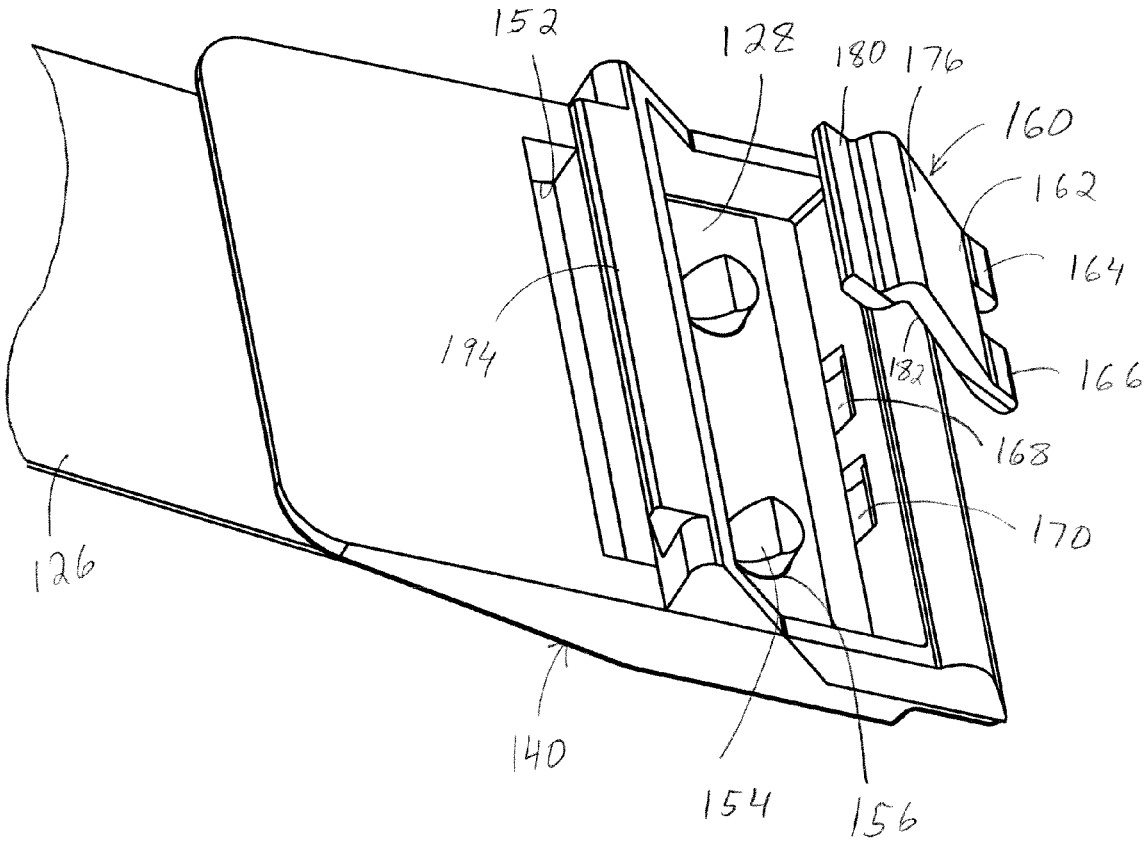

The second end 128 of the coil spring is mounted to a mounting clip 140. With reference now also to FIG. 8B, the mounting clip comprises a front end 142 extending from which is a tongue 144 and a rear end 146. Connecting the front and rear ends are first and second side walls 148 and 150 as best shown in FIG. 9. A slot 152 is defined in the mounting clip. The slot accommodates the second end 128 of the coil spring. With reference now also to FIG. 10, depending from a bottom face of the mounting clip is at least one stub 154. Two such stubs are illustrated in the embodiment of FIG. 10. The stubs are accommodated in suitably sized and spaced apertures 156 located adjacent the front edge of the coil spring second end 128. In this way, the front end of the coil spring can be connected to the mounting clip 140.

Also connected to the mounting clip is a locking member or locking element 160. The locking member includes a first end 162 extending from which are spaced first and second protrusions 164 and 166. Such protrusions are accommodated in suitable slots 168 and 170 defined in the mounting clip 140. The locking member 160 also includes a central section 176 and a second end 180. With reference again to FIG. 8B, it can be seen that a face 182 of the mounting clip 160 contacts the stubs 154 so as to prevent the coil spring second end 128 from becoming detached from the mounting clip. The locking member second end 180 contacts a further section of the mounting clip. More particularly, it contacts a first leg 190 of a connecting element which also includes a second leg 192 and a protrusion 194. The protrusion 194 cooperates with the front face 30 of the plateau-like section 29 of the front rail 10. In this way, the mounting clip 140, and hence, the pusher system 100 can be selectively secured to the front rail. In other words, the tongue 144 and the protrusion 194 cooperate in order to selectively secure the mounting clip 140 to the front rail 10. The mounting clip can be detached from the front rail by rotating the mounting clip around its horizontal axis, or around the horizontal axis of the pusher system. The natural resiliency of the material from which the mounting clip 140 is made, and the locking member 160 is made (they can be made of conventional metal or plastic materials) allows the mounting clip to be connected to or disconnected from the rail 10.

It should be appreciated that the base wall first and second sections 110 and 112, the guide wall 116 and the bottom edge 118 of the front wall cooperate to form an alignment structure for the coil spring 120. The coil spring 120 is biased against the pusher body 101 on which it is mounted. The spiral spring unwinds and biases the pusher body towards the front rail 10 when the pusher body is drawn rearwardly away from the rail. As is well known, retail merchandise is positioned between the pusher front face or front wall 102 and the vertical wall 12 of the rail 10, or a barrier (not shown) mounted in the groove 16 (FIG. 1). The pusher body 101 is physically separated from the mounting clip 140. Only the spring 120 connects the pusher body 101 to the mounting clip 140.

It should be apparent that the pusher system 100 is infinitely variable in length so as to accommodate any desired depth of the shelving on which it is supported. The infinite variability of the pusher system is brought about by the lack of a physical connection between the front clip 140 and the pusher body 101. In other words, in this design, no track is provided on which the pusher body 101 can ride. Rather, the pusher body rides simply on the subjacent shelf on which the pusher system 100 is supported.

Thus, the disclosed merchandising apparatus A includes both a variable length divider system 50 and a variable length pusher system 100. In this way, shelving of almost all conventional types can be accommodated by the merchandising apparatus disclosed herein. In other words, a single merchandising apparatus according to the present disclosure can be configured to fit a large number of conventional shelving installations having varying depths. This will reduce the inventory of merchandising apparatus that needs to be stocked by a merchant in order to accommodate various shelving systems the merchant may have in a particular retail installation.

It should also be appreciated that the divider system 50 and pusher system 100 can be selectively connected to or disconnected from the front rail 10. FIG. 2 illustrates the divider system 50 in the process of being either connected to or disconnected from the front rail 10.

If desired, the merchandise can be supported on the flat linear or straight portion 126 of the coil spring and disposed between a pair of spaced divider systems, so as to maintain the merchandise in a tight linear arrangement on the shelf. This configuration keeps retail merchandise centered while it is being moved toward the front rail. Alternatively, the side edges of a piece of merchandise (not illustrated) can be supported by respective rails of two spaced divider systems 50 such that the merchandise is not contacting the straight portion 126 of the spring but, rather, is spaced above it. Such an arrangement may be preferable as it might be easier for the pusher body 101 to slide in relation to the shelf 26 if merchandise is not contacting the flat portion 126 of the coil spring.

The pusher system disclosed herein also takes up less space on a retail shelf and is less expensive than known systems since it is trackless and the need for a track, and the necessary material used for same, is avoided. The several components of the merchandising apparatus disclosed therein, namely, the front rail 10, the divider system 50 and the pusher system 100 can be predominantly made of a suitable conventional thermoplastic material. However, the coil spring 120 is most often made of a resilient metallic material if so desired. Also, the locking member 160 can be made of a resilient metallic material. Of course, any suitable materials can be used to construct the various components of the disclosed merchandising apparatus.

The disclosure has been described with reference to a preferred embodiment. Obviously, modifications and alterations will occur to others upon a reading and understanding of this specification. It is intended to include all such modifications and alterations insofar as they come within the scope of the appended claims or the equivalents thereof.

What is claimed is:

1. An adjustable depth merchandising apparatus comprising:

an elongated mounting member operationally securable to an associated shelf and extending parallel to a longitudinal axis thereof;

an adjustable divider system selectively connected to said mounting member, wherein said divider system extends rearwardly over the associated shelf; and, a trackless pusher system selectively connected to said mounting member and extending rearwardly over the associated shelf, wherein each of said divider system and said pusher system is selectively extendible so that an operative length of said respective system can be adjusted, thereby enabling the merchandising apparatus to be employed on associated shelves of varying depths;

wherein said divider system comprises:

a first divider portion including a base section comprising a first locking element; and a second divider portion including a base section comprising a second locking element which selectively cooperates with said first locking element, wherein said first and second divider portions are selectively detachable from each other for adjustment of the length of the divider system;

wherein said first divider portion base section is horizontally oriented and said first divider further includes a vertically oriented barrier section and said second divider portion base section is horizontally oriented and said second divider portion further includes a vertically oriented barrier section.

2. The apparatus of claim 1 wherein the trackless pusher system comprises:

a pusher body;

a mounting clip; and a spring extending between and connecting said pusher body to said mounting clip.

3. The apparatus of claim 2 wherein said pusher body comprises a rectangular member including a front wall.

4. An adjustable depth merchandising apparatus comprising:

an elongated mounting member operationally securable to an associated shelf and extending parallel to a longitudinal axis thereof;

an adjustable divider system selectively connected to said mounting member, wherein said divider system extends rearwardly over the associated shelf; and, a trackless pusher system selectively connected to said mounting member and extending rearwardly over the associated shelf, wherein each of said divider system and said pusher system is selectively extendible so that an operative length of said respective system can be adjusted, thereby enabling the merchandising apparatus to be employed on associated shelves of varying depths;

wherein said divider system comprises:

a first divider portion comprising a first locking element; and, a second divider portion selectively engaging the first divider portion and comprising a second locking element, wherein said first and second locking elements cooperate with each other to secure the divider system in a desired configuration; and wherein said first divider portion includes an overhang which protrudes above the second divider portion when the first divider portion engages the second divider portion.

5. The apparatus of claim 4 wherein the first divider portion further comprises a third locking element spaced from the first locking element and the second divider portion further comprises a fourth locking element spaced from the second locking element, wherein the third and fourth locking elements selectively engage each other.

6. The apparatus of claim 5 wherein the third locking element comprises a vertically oriented wall portion and the fourth locking element comprises an overhang portion.

7. The apparatus of claim 4 wherein said second divider portion is movable along the longitudinal axis of said first divider portion to allow a length of the divider system to be changed, thereby enabling the divider system to be employed on associated shelves of varying depths.

8. The apparatus of claim 7 wherein said first locking element comprises an aperture defined on said first base section and said second locking element comprises a tooth defined on said second base section, the tooth selectively protruding into the aperture.

9. The apparatus of claim 8 wherein a plurality of apertures are defined on the first base section and a plurality of teeth are defined on the second base section.

10. The apparatus of claim 9 wherein said plurality of apertures extend along a longitudinal axis of said first divider portion.

11. The apparatus of claim 4 wherein the mounting member includes a first connecting member, the divider system includes a second connecting member which is adapted to cooperate with the first connecting member and the trackless pusher system includes a third connecting member which is adapted to cooperate with the first connecting member.

12. An adjustable depth merchandising apparatus comprising:

an elongated mounting member operationally securable to an associated shelf and extending parallel to a longitudinal axis thereof;

an adjustable divider system selectively connected to said mounting member, wherein said divider system extends rearwardly over the associated shelf; and, a trackless pusher system selectively connected to said mounting member and extending rearwardly over the associated shelf, wherein each of said divider system and said pusher system is selectively extendible so that an operative length of said respective system can be adjusted, thereby enabling the merchandising apparatus to be employed on associated shelves of varying depths;

wherein said pusher system comprises:

a mounting clip which selectively cooperates with an elongated mounting member;

a pusher body; and a spring extending between and connecting said mounting clip to said pusher body, said spring acting on said pusher body to bias it towards said mounting clip, wherein said pusher body is physically separate from said mounting clip and is connected thereto only by said spring, so that the pusher system has a length which can be adjusted, thereby enabling the pusher system to be placed on associated shelves of varying depths, wherein said pusher body comprises a rectangular member including a front wall, a pair of side walls, a rear wall and a base member on which a coiled portion of said spring is supported.

13. The apparatus of claim 12 wherein said rectangular member further comprises a guide wall extending between said pair of side walls, in spaced relationship to said front and rear walls.

14. The apparatus of claim 12 wherein said base wall comprises a flange which cooperates with a rear wall of said rectangular member to accommodate said coiled portion of said spring.

15. The apparatus of claim 14 wherein said base wall further comprises a bracing member which is spaced from said flange.

16. The apparatus of claim 12 wherein said mounting clip comprises:

a clip body;

a tongue located on a first end of said clip body; and, a protrusion located along a length of said clip body.

17. The apparatus of claim 16 wherein said mounting clip further comprises:

a locking element; and a stub extending through an aperture located in said spring, wherein said locking element cooperates with said stub.

18. The apparatus of claim 12 wherein said pusher body further comprises a guide wall which is spaced from said base wall and wherein said spring extends above said base member and beneath said guide wall.

* * * * *